US010032598B2

(12) United States Patent
Olsen

(10) Patent No.: US 10,032,598 B2
(45) Date of Patent: Jul. 24, 2018

(54) X-RAY SYSTEMS AND METHODS INCLUDING X-RAY ANODES

(71) Applicant: Neil Dee Olsen, Bountiful, UT (US)

(72) Inventor: Neil Dee Olsen, Bountiful, UT (US)

( * ) Notice: Subject to any disclaimer, the term of this patent is extended or adjusted under 35 U.S.C. 154(b) by 211 days.

(21) Appl. No.: 15/220,158

(22) Filed: Jul. 26, 2016

(65) Prior Publication Data

US 2018/0033583 A1 Feb. 1, 2018

(51) Int. Cl.
*H01J 35/08* (2006.01)

(52) U.S. Cl.
CPC ..... *H01J 35/08* (2013.01); *H01J 2235/081* (2013.01)

(58) Field of Classification Search
CPC ..... H01J 2235/081; H01J 35/08
See application file for complete search history.

(56) References Cited

U.S. PATENT DOCUMENTS 4,090,103 A 5/1978 Machenschalk et al.
4,184,097 A 1/1980 Auge
4,870,672 A 9/1989 Lindberg
4,953,191 A 8/1990 Smither et al.
5,181,235 A 1/1993 Ono et al.
6,075,839 A * 6/2000 Treseder ..... H01J 35/06 378/136
2010/0008471 A1* 1/2010 Morton ..... G21K 1/02 378/141
2010/0040202 A1 2/2010 Lee
2014/0211919 A1* 7/2014 Ogura ..... H01J 35/08 378/62

FOREIGN PATENT DOCUMENTS

JP S56141153 A 11/1981
JP H0719533 B2 3/1995

* cited by examiner

*Primary Examiner* — Mark R Gaworecki
(74) *Attorney, Agent, or Firm* — Phillips, Ryther & Winchester; Justin Flanagan

(57) ABSTRACT

An anode for an X-ray tube can include a ceramic body, e.g., material that includes yttrium-oxide derivatives. Upon collision with an anode, the kinetic energy of an electron beam in an X-ray tube is converted to high frequency electromagnetic waves, i.e., X-rays. An anode with a ceramic body can reduce costs and/or weight, extend the life of the anode or associated components (e.g., bearings) and simultaneously provide a high heat storage capacity.

21 Claims, 7 Drawing Sheets

X-RAY SYSTEMS AND METHODS INCLUDING X-RAY ANODES

TECHNICAL FIELD

The present disclosure relates generally to X-ray systems including x-ray anodes of X-ray tubes. More specifically, the present disclosure relates to an anode with a ceramic body.

BACKGROUND

X-ray beam generating devices, or X-ray tubes, typically comprise dual electrodes of an electrical circuit within an evacuated chamber or tube. The electrical circuit generates a beam of electrons, which are emitted by a cathode and accelerated across a potential difference toward an anode target. The electrons collide with the anode target resulting in energy that is emitted as an X-ray. One of the problems frequently encountered with anodes is that the material from which they are formed must be able to withstand high temperatures and repeated operation. The materials commonly utilized to form X-ray anodes are heavy and relatively expensive metals.

BRIEF DESCRIPTION OF THE DRAWINGS

The written disclosure herein describes illustrative embodiments that are non-limiting and non-exhaustive. Reference is made to certain of such illustrative embodiments that are depicted in the figures described below.

DESCRIPTION

Figure 1:
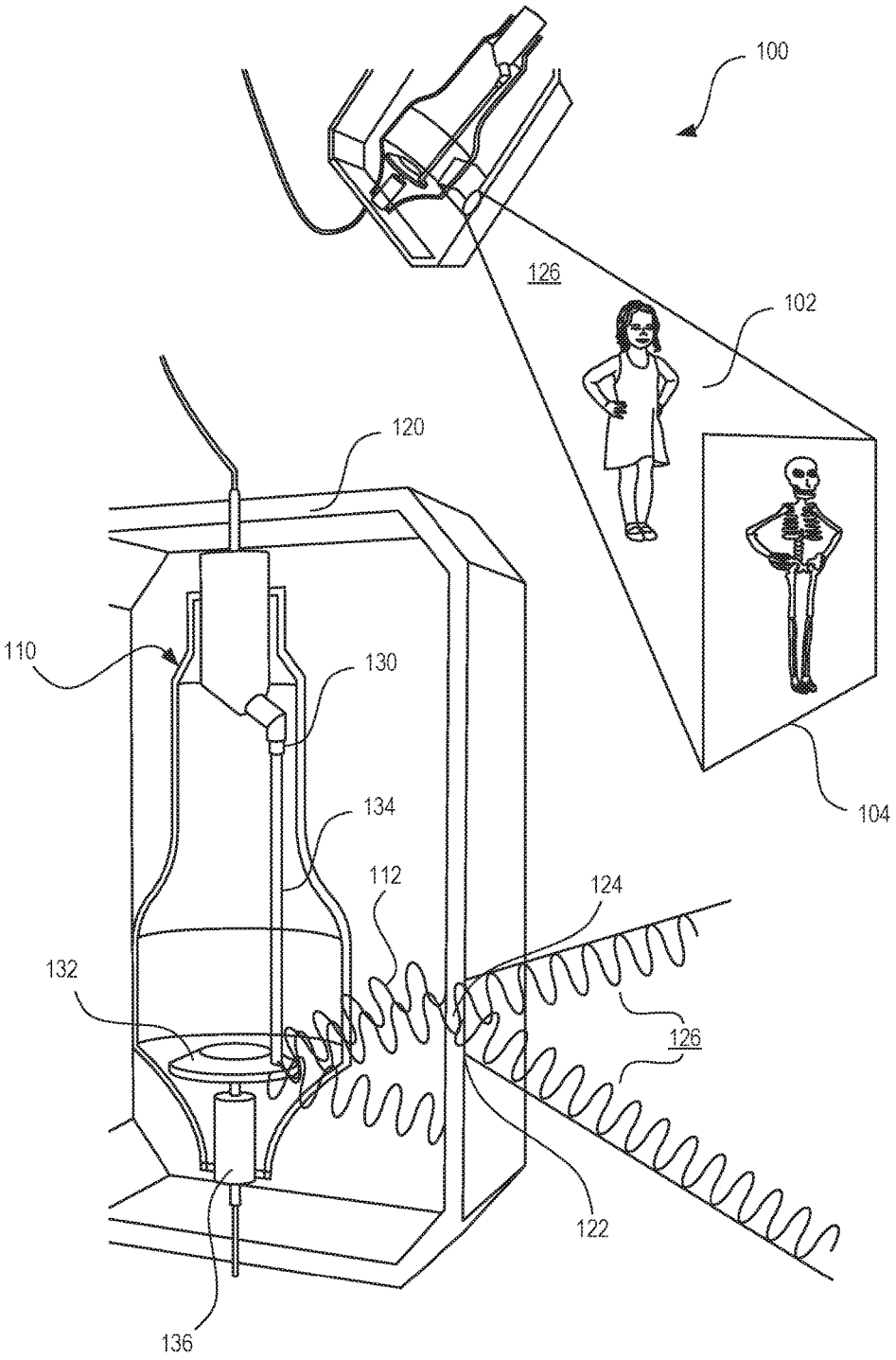
FIG. 1 illustrates an X-ray beam generating system, with a cross-sectional view of an X-ray tube.

An X-ray anode may include a ceramic body that emits X-rays at least when it is in a thermally excited state in response to incident electrons from an electron beam. For at least a first temperature range, the X-ray anode may increase in thermal conductivity with increased temperature. That is, as the temperature of the X-ray anode increases, the thermal conductivity increases. In one embodiment, the X-ray anode may be a yttrium-based ceramic that is a poor conductor (electrically and/or thermally) at ambient temperatures.

However, as the temperature of the yttrium-based ceramic anode increases, the thermal and/or electrical conductivity increases. As such, while an ambient temperature yttrium-based ceramic anode may not provide a suitable anode for an X-ray system, a heated yttrium-based ceramic anode may provide a suitable anode for an X-ray system.

In various embodiments, an anode may include one or more conductive metal wires thermally coupled to the ceramic body to receive a plurality of incident electrons from the electron beam. During operation, the received plurality of incident electrons increases the thermal energy in the conductive metal wires, and the conductive metal wires diffuse the increase in thermal energy to the ceramic body, such that the temperature of the ceramic body increases as does the thermal conductivity of the ceramic body for at least the first temperature range (e.g., ambient temperature to sub 2,500 degree Celsius temperatures).

In various embodiments, the X-ray anode comprises yttrium aluminum garnet. In a thermally unexcited state, such as temperatures in a range below 100 degrees Celsius, the X-ray anode may be a poor conductor. However, in a thermally excited state, such as a temperature range above 150 degrees Celsius, the X-ray anode may be a good conductor. A temperature range during which increased temperatures result in increased conductivity may include a temperature range between 30 degrees Celsius and 500 degrees Celsius.

In various embodiments, conductive metal wires may extend radially out relative to the ceramic body. In some embodiments, conductive metal wires may form a spiral beginning at or near a center of the ceramic body and ending at or near the edge of the ceramic body. In some embodiments, the spiral tightens proximate the location where the electron beam strikes the anode. The conductive metal wires may be partially contained within the ceramic body. The conductive metal wires may be exposed proximate a location at which the electron beam strikes the X-ray anode.

As described herein, an aperture may be formed through the anode to allow for a shaft to be connected to the X-ray anode. Rotation of the shaft may cause the anode to rotate during operation. In one embodiment, the ceramic body comprises yttrium oxide. In one embodiment, the ceramic body consists of exclusively yttrium oxide. In one embodiment, the ceramic body consists of exclusively yttrium oxide with doped metals, plated metals, or metal wires added thereto.

The X-ray anode may include a metal backing. The metal backing may be used to balance the anode for rotation.

It will be readily understood that the components of the embodiments as generally described and illustrated in the figures herein could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale.

In the following disclosure, an "anode" may also be referred to as an "X-ray tube anode" or "X-ray anode" and may contextually refer to the anode body or a target portion of an anode that is struck by electrons from the cathode. In various embodiments, the anode may be a "ceramic" or a "crystalline ceramic." An X-ray target and an X-ray anode may be used interchangeably as can be contextually understood when the discussion does directly relate to the region of an X-ray anode specifically impinged with electrons from an electron beam.

The phrases "connected to" and "coupled to" are used in their ordinary sense, and refer to any suitable coupling or other form of interaction between two or more entities, including mechanical, fluid and thermal interaction. Two components may be connected to each other even though they are not in direct contact with each other.

X-ray tubes may be used to convert electrical input power into X-rays. Within an X-ray tube, a cathode may emit electrons into a vacuum. An anode target may collect the electrons, thus forming an electrical current or electron beam inside the X-ray tube. Upon collision with an anode target, the kinetic energy of the electron beam is converted to high frequency electromagnetic waves, i.e., X-rays. In some embodiments, the X-rays may be collimated and focused for penetration through an object for internal examination purposes.

Within an X-ray tube, the high velocity electron beam that impinges on an anode target surface can generate extremely high and localized temperatures within or on the anode structure. High temperatures within or on the anode structure may induce high internal stresses. The high internal stresses can lead to deterioration and breakdown of the anode, especially a target portion of the anode (i.e., an electron impact region of the anode). In various embodiments, a rotating anode may be used. A rotating anode may include a disk-like structure supported by a shaft, one side or face of which is exposed to the electron beam from a thermionic emitter cathode. By means of anode rotation, the impinged region of the target is continuously changing to avoid localized heat concentration and stresses, and to better distribute the heating effects throughout the anode structure. Increased rotation of an anode may improve heat dissipation and radiation. Accordingly, rotation speeds may be between 1,000 rotations per minute (rpm) and 30,000 rpm. For example, an anode may be rotated at 10,000 rpm. A motor or other electromechanical rotational device may rotate a shaft connected to a center of an anode. For example, an induction motor, which includes a stator housed outside the X-ray tube and a rotor located within the X-ray tube, may be connected to the shaft to stimulate shaft rotation.

The composition of an anode may include any material or combination of materials that can withstand the temperatures induced by the electron beam emitted by the cathode and also emit X-rays. The anode may transfer heat to the X-ray tube or envelope structure. The heat storage capacity of the anode body may be relatively high to account for a relatively inefficient heat transfer from the anode to the X-ray tube or envelope structure.

In one embodiment, only about 1.0% of the energy of the impinging electron beam is converted to X-rays with the remainder appearing as heat that must be absorbed and/or dissipated from the anode essentially by means of heat radiation. The temperature of any single incident point on the focal track of the electron beam can exceed 2,500 degrees Celsius. In addition, the material may be configured with sufficient ductility to withstand conditions of repeated operation. Accordingly, some anodes include a large percentage of graphite, which has a high heat storage capacity and readily accepts bonding of a refractory metal cover or surface. In other embodiments, anodes can be mostly or completely composed of refractory metal. The target region of the anode can be of a separate material from the anode body, or the material of the entire anode can be homogenous throughout. The anode target that is exposed to the impinging electron beam often includes copper, iron, silver, chromium, cobalt, tungsten, molybdenum, and/or their alloys.

Anodes may be disc-like in shape, with a topmost surface that is directed toward the cathode and a flat base facing opposite the cathode. The topmost surface may include a beveled edge, with the center of the anode generally being thicker in depth than the periphery of the anode, and the topmost surface sloping down from the center towards the edges of the anode. The center of an anode may include a cavity through which a shaft connected to a rotating motor can penetrate. An anode body can include multiple layers of material, or have a solid body encased or plated with an alternative material, such as a refractory metal.

Within an X-ray tube, the combination of elevated temperatures with the high rotational speed of an anode leads to the generation of severe stresses on the anode. These stresses can result in deterioration and/or structural failure of the anode body, the anode target, or other components of the X-ray tube, such as bearings associated with rotation of the anode. Replacement of an anode can be burdensome due to the nature of the anode materials. According to various embodiments of the present disclosure, a high flux X-ray tube configuration is provided that includes an anode with sufficient heat dissipation and life expectancy that is easy to manufacture, cheaper, and lighter than an anode manufactured from refractory metals.

Anode bodies for X-ray tubes that have high percentages of graphite and/or refractory metal necessary for functionality can be heavy and/or expensive. Accordingly, various embodiments disclosed herein provide alternative materials for an anode body that reduces the burden of replacing an anode by limiting the costs and/or weight, while simultaneously maintaining a high heat storage capacity for proper heat dissipation. According to various embodiments of anode bodies disclosed herein, the anodes may provide improved reliability and extended life expectancy.

Certain ceramics have an electrical insulating quality, provide heat-resistance, and are robust. Crystalline ceramics can provide sufficient heat dissipation for an X-ray tube, and include components capable of maintaining an extended life with a limited introduction of cost and manufacturing complexity. In one embodiment, transparent crystalline ceramics, such as yttrium-oxide derivatives, are included in the material composition of an anode for an X-ray tube. Specifically, yttrium aluminum oxide, also known as yttrium aluminum garnet, may be utilized to form an anode.

FIG. 1 is a representation of an X-ray beam generating system 100, according to one embodiment, with a sectional view of the X-ray tube assembly 110. The X-ray beam generating system 100 includes a thick lead case 120 to control X-ray radiation. The X-rays 112 may escape the X-ray tube assembly 110 via a small window 122 in the lead case 120. The small window 122 lets some of the X-rays 112 escape from the X-ray beam generating system 100. In some embodiments, X-rays 112 may pass through one or more filters 124. In some embodiments, the X-rays 112 are directed towards a human subject 102 in the form of an X-ray beam 126. The X-ray beam 126 may be used to penetrate visually opaque objects, such as a human subject 102, and produce a radiograph 104, often referred to as an X-ray image, of a subject 102.

The X-ray beam generating system 100 includes an X-ray tube assembly 110 where a heated filament or cathode 130 emits electrons in the form of an electron beam 134 into the X-ray tube assembly 110 and an anode 132 collects the electrons. The X-ray tube assembly 110 may be immersed in an oil bath to absorb excess heat. A motor 136 rotates the anode 132 to avoid localized heat concentration and stresses on the anode 132. In response to the electrical input power from the electron beam 134, the anode 132 produces X-rays 112.

Figure 2:
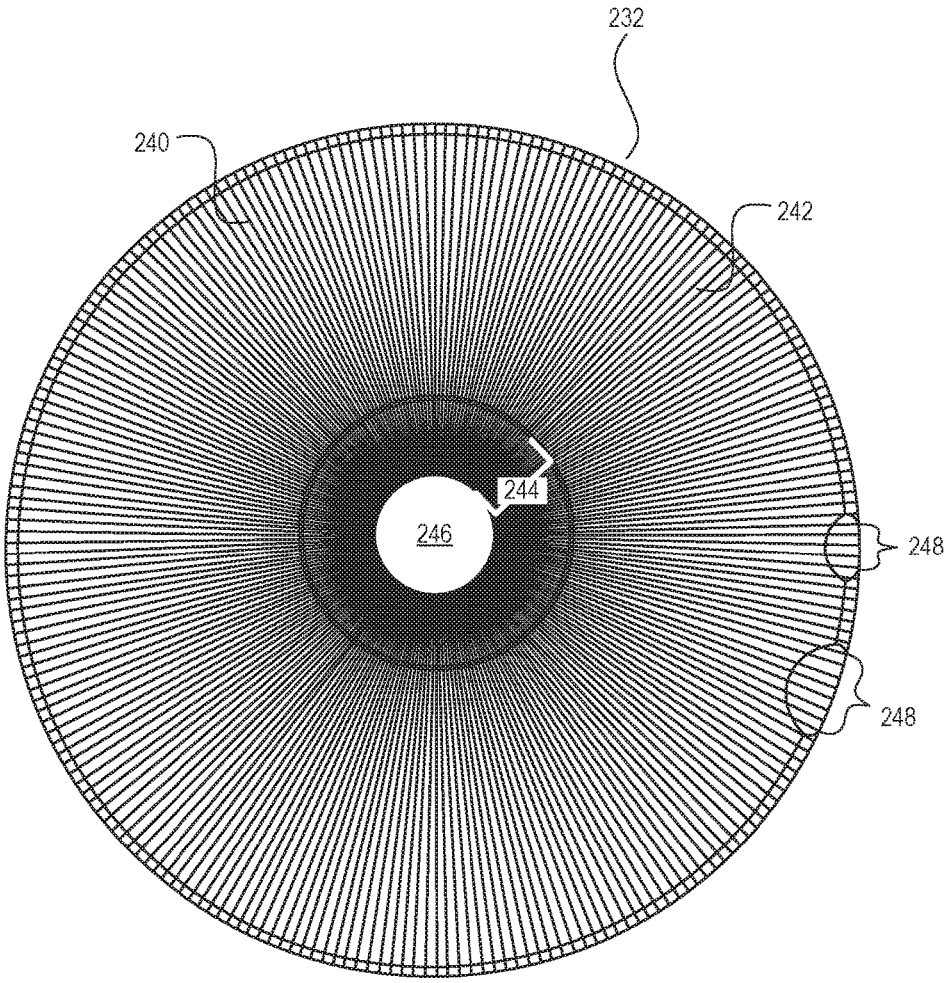
FIG. 2 is a view of the base of an anode for an X-ray tube, according to one embodiment, with metal wires extending radially from the center of the anode to a peripheral portion of the anode.

FIG. 2 is a view of the base of an anode 232 for an X-ray tube, according to one embodiment, with one or more metal wires 242 extending radially, similar to spokes of a wheel, from the center of the anode 232 to the peripheral portion of the anode 232. The anode 232 includes a crystalline ceramic body 240 in the shape of a disc, and an array of thin metal wires 242 that are connected to the crystalline ceramic body 240.

In various embodiments, the crystalline ceramic body 240 may not conduct electricity in a first, cool temperature or state. The metal wires 242 may initially distribute heat received from electrons to the crystalline ceramic body 240 to warm the crystalline ceramic body 240 to a second temperature or state in which the crystalline ceramic body 240 does conduct electricity.

The metal wires 242 are positioned radially and can collect heat from an electron beam. The metal wires 242 can include any electrically conductive metal capable of withstanding the temperatures necessary for functionality. The heat from the metal wires 242 can then be transferred and distributed to the crystalline ceramic body 240 so that the crystalline ceramic body 240 is hot enough to conduct electricity.

In the center of the anode 232 is a center cavity 246 through which a shaft connected to a motor can penetrate. A motor (see, e.g., motor 136 in FIG. 1) induces rotation of the shaft, and the shaft is connected to the anode 232 at the center cavity 246. The section of the crystalline ceramic body 240 that most closely surrounds the center cavity 246 can form an indented rim 244 around the center cavity 246 to contribute to the stability and/or functionality necessary for rotation of the anode 232. The crystalline ceramic body 240 can have one or more notches 248 forming an indentation on the outside edge of the base of the anode 232. The notches 248 can vary in depth and breadth, and may be positioned so as to balance the weight of a spinning anode 232. Alternatively, a metal backing may be selectively added (or added and then notched) to balance the anode 232.

Figure 3:
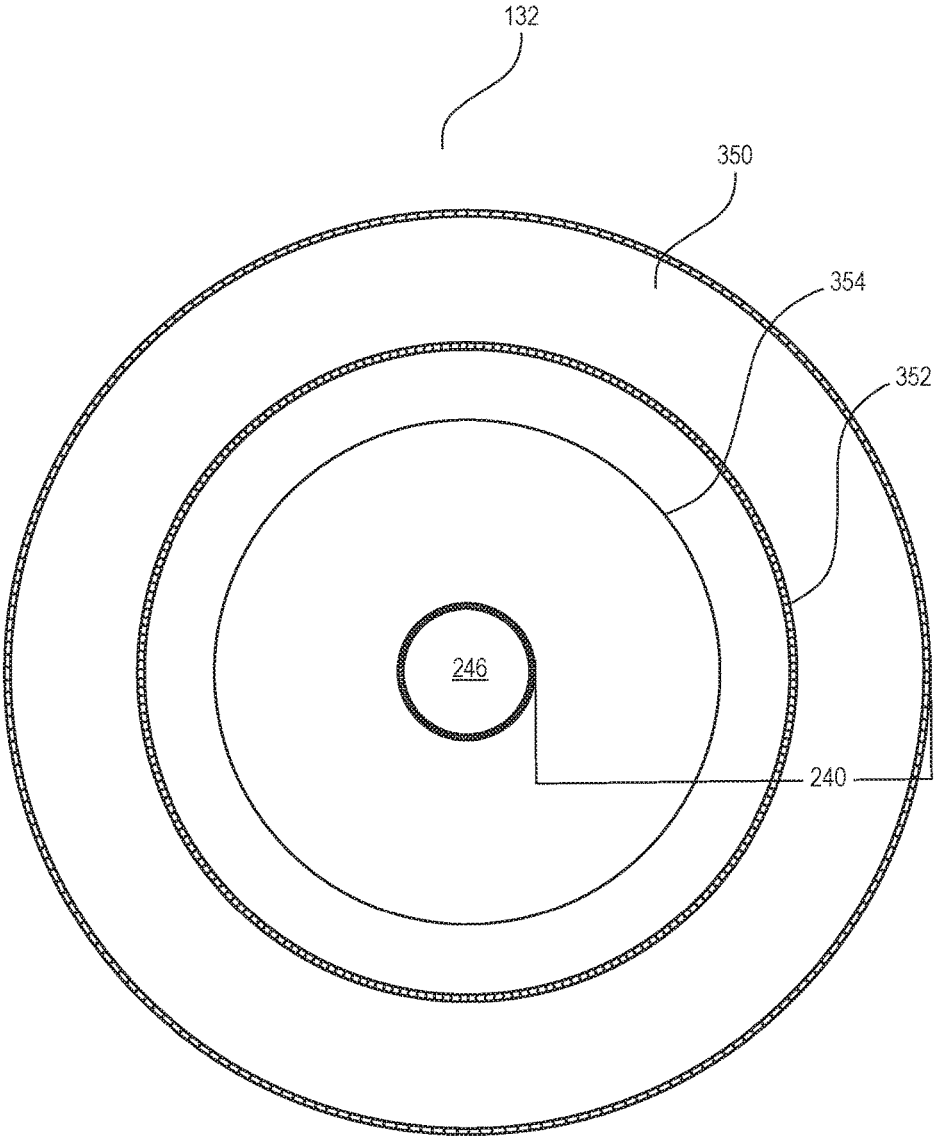
FIG. 3 is an overhead view of a topmost surface of the anode of FIG. 2.

FIG. 3 is an overhead view of the topmost surface 350 of the anode 232 of FIG. 2. The crystalline ceramic body 240 includes a beveled surface 350 that slopes down and away from the center of the anode 232 such that the depth of the crystalline ceramic body 240 is thinner at the periphery than the interior of the anode 232. The region closest to the center of the anode 232 is flat, but the surface 350 begins to slope at an inflection point 354 and continues in the sloped trajectory until the edge of the anode 232. In the center of the anode 232 is a center cavity 246 through which a shaft connected to a rotating motor can penetrate.

A focal track 352 is the impact region of an electron beam as the electrons impinge the surface 350 of the anode 232 during rotation. The focal track 352 of the anode 232 can be composed of the same material as the crystalline ceramic body 240, or include a refractory metal, e.g., tungsten, that is coupled to the crystalline ceramic body 240.

Figure 4:
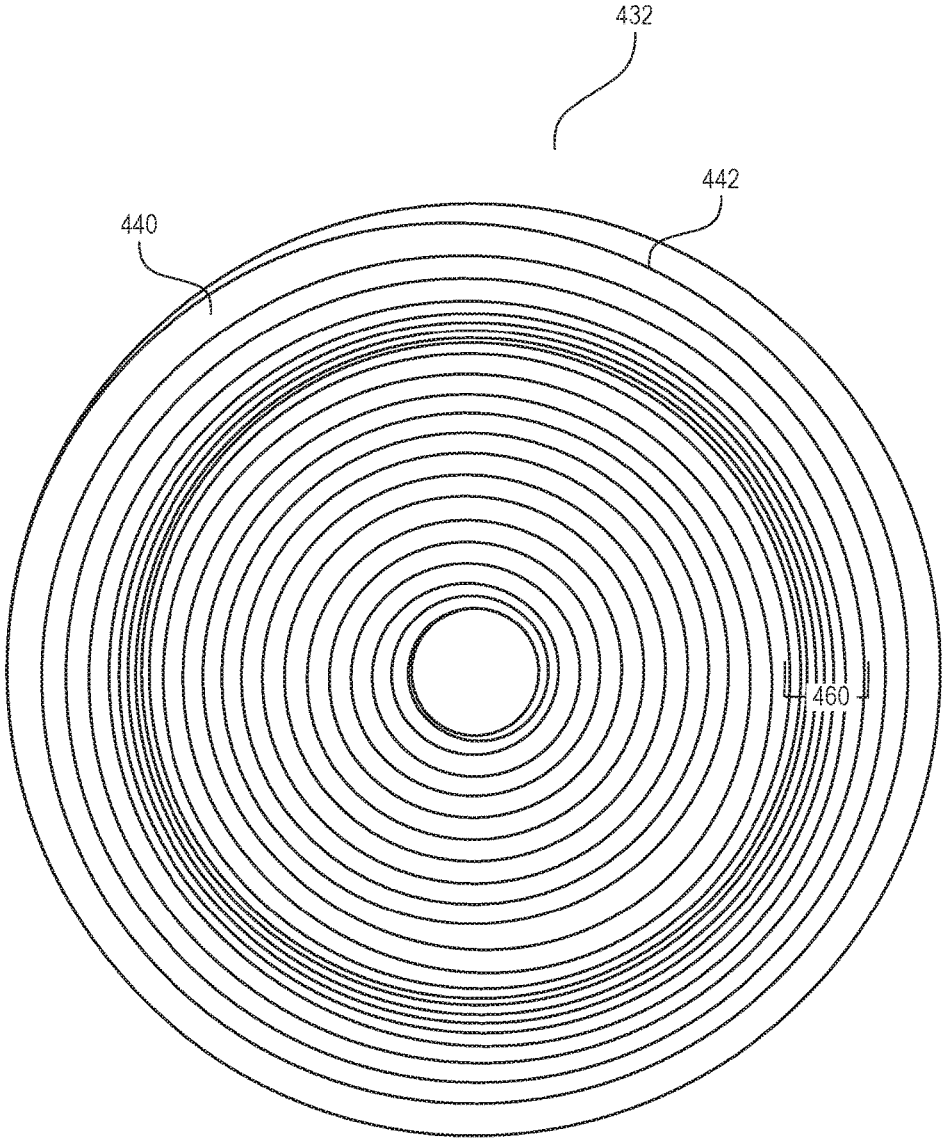
FIG. 4 is a view of a base of an anode for an X-ray tube, according to one embodiment, with a continuous metal wire that forms a spiral around the center of the anode and incrementally expands in diameter as the metal wire gets closer to a periphery of the anode.

FIG. 4 is a view of the base of an anode 432 for an X-ray tube, according to one embodiment, with a continuous metal wire 442 that forms a spiral around the center of the anode 432, and incrementally expands in diameter as the metal wire 442 gets closer to the periphery of the anode 432. The rotations of the metal wire 442 can be uniformly spaced or can have a varied spacing such that certain clusters 460 of the metal wire 442 can be tightly spiraled while other sections are spaced wider apart. The clusters 460 of metal wire 442 can be positioned at the locations of the crystalline ceramic body 440 where an electron beam typically strikes a surface of the anode 432, otherwise known as a focal track. The metal wires 442 can include any electrically conductive metal capable of withstanding the temperatures necessary for functionality. The heat from the metal wires 442 can then be transferred to the crystalline ceramic body 440 so that the crystalline ceramic body 440 is hot enough to conduct electricity.

Figure 5:
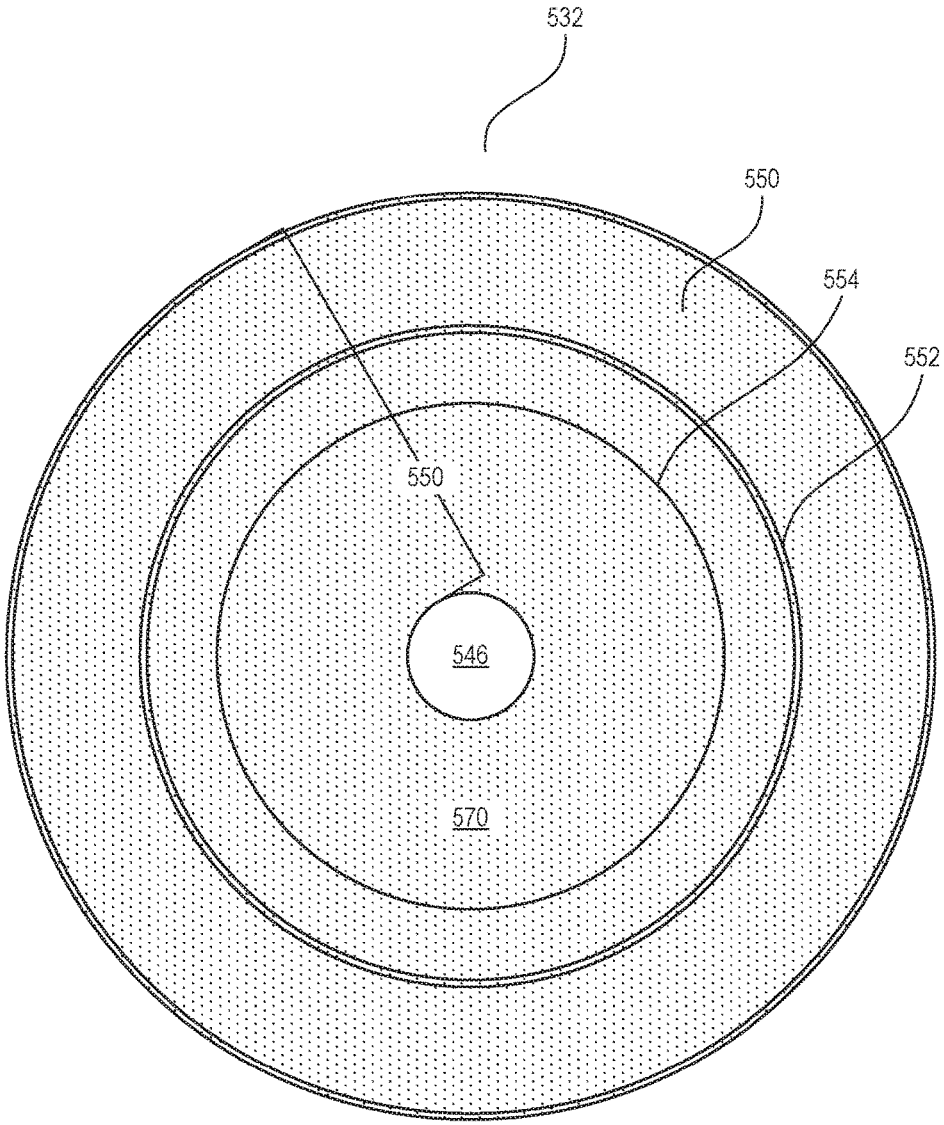
FIG. 5 is an overhead view of an anode for an X-ray tube, according to one embodiment, in which pixels distributed uniformly throughout the anode represent that the anode has been doped or infused with an electrically conductive material.

FIG. 5 is an overhead view of an anode 532 for an X-ray tube, according to one embodiment, in which pixels distributed uniformly throughout the crystalline ceramic body represent that the anode 532 has been doped or infused with an electrically conductive material 570. The crystalline ceramic body includes a beveled surface 550 that slopes down and away from the center of the anode 532 such that the depth of the crystalline ceramic body is thinner at the periphery than the interior of the anode 532. The region closest to the center of the anode 532 is flat, but the surface 550 begins to slope at an inflection point 554 and continues in the sloped trajectory until the edge of the anode 532. In the center of the anode 532 is a center cavity 546 through which a shaft connected to a rotating motor can penetrate.

A focal track 552 is the impact region where electrons from an electron beam impinge the surface 550 of the anode 532 during rotation. The focal track 552 of the anode 532 may be manufactured of the same material as the crystalline ceramic body that is doped or infused with one or more electrically conductive material(s) 570.

Figure 6:
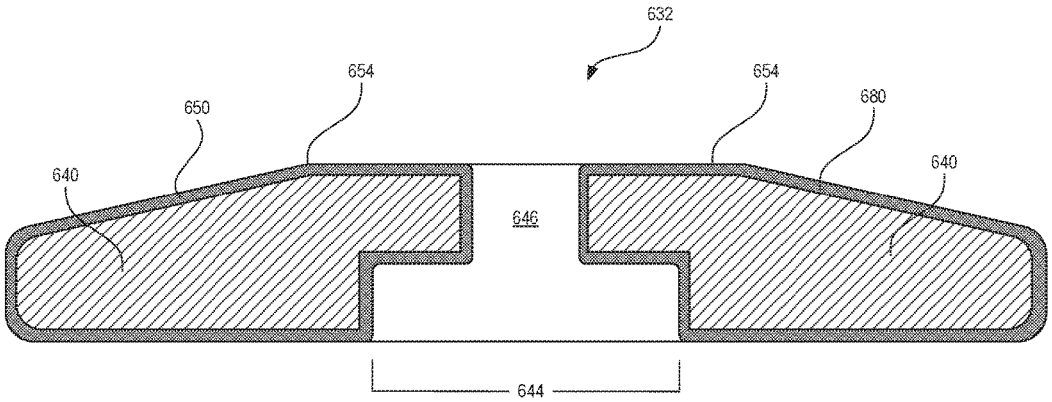
FIG. 6 is a side cross-sectional view of an anode for an X-ray tube, according to one embodiment, in which a plated layer or film of metal encapsulates the anode body.

FIG. 6 is a side cross-sectional view of an anode 632 for an X-ray tube, according to one embodiment, in which a plated layer or film 680 of metal completely encapsulates the crystalline ceramic body 640. The crystalline ceramic body 640 includes a beveled surface 650 that slopes down and away from the center of the anode 632 such that the depth of the crystalline ceramic body 640 is thinner at the periphery than the interior of the anode 632.

In all embodiments disclosed herein, the specific shape, beveling, thicknesses, slopes, relative thicknesses, and the like may be modified or changed. For example, the anodes (e.g., 132, 232, 432, 532, 632) need not be thinner at the periphery, include any beveling or inflection points, or indeed even be disk shaped. That is, the principles of heat distribution and weight reduction taught herein may be applied to any shape anode.

Returning to FIG. 6, the region closest to the center of the anode 632 is flat, but the surface 650 begins to slope at an inflection point 654 and continues in the sloped trajectory until the edge of the anode 632. In the center of the anode 632 is a center cavity 646 through which a shaft connected to a rotating motor can penetrate. The section of the crystalline ceramic body 640 that most closely surrounds the center cavity 646 can form an indented rim 644 around the center cavity 646 to contribute to the stability and/or functionality necessary for rotation of the anode 632.

The film 680 that completely encapsulates the crystalline ceramic body 640 may include a refractory metal. Electrons from an electron beam impinge the surface 650 of the anode 632 at the focal track, which is located on the film 680. The received electrons produce an increase in thermal energy in the film 680. The increase in thermal energy from the film 680 can be transferred or diffused to the crystalline ceramic body 640 so that the crystalline ceramic body 640 is hot enough to conduct electricity and/or thermal energy. The film 680 can be thermally coupled to the ceramic body 640.

Figure 7:
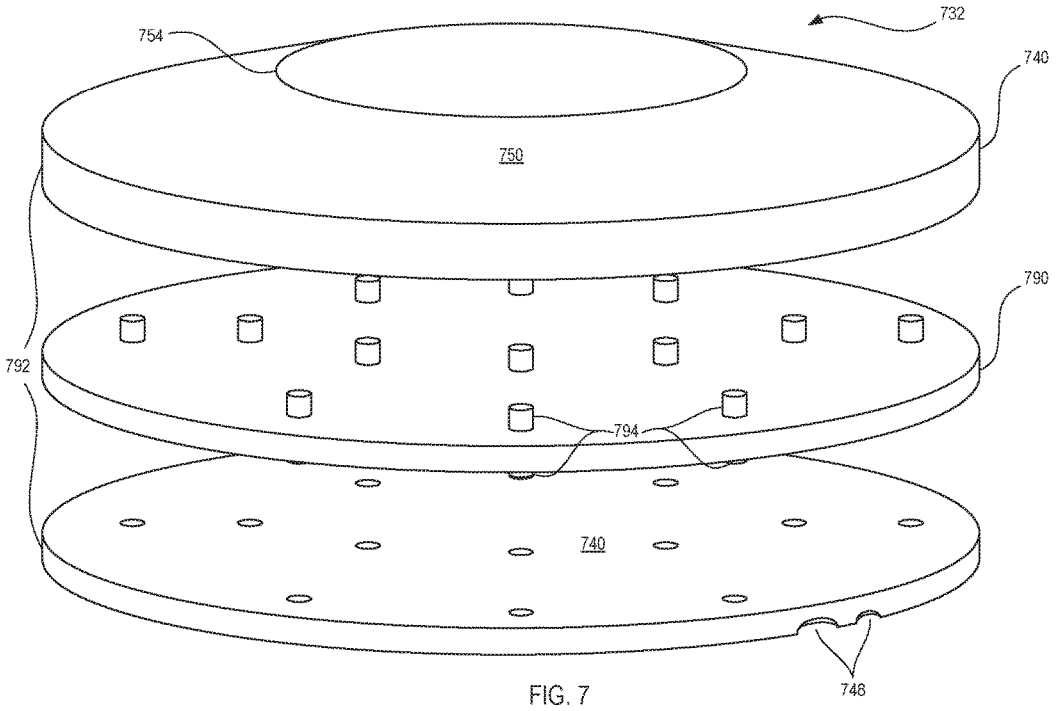
FIG. 7 illustrates a side view of an anode for an X-ray tube, according to one embodiment, that is separated into three layers to show a metal layer located between two crystalline ceramic layers.

FIG. 7 illustrates a side view of an anode 732 for an X-ray tube, according to one embodiment, that is separated into three layers to demonstrate a metal layer 790 located in the middle of two crystalline ceramic layers 792. The illustrated embodiment does not show a center cavity. In such an embodiment, a rotating shaft may be connected to the bottom layer 740. In other embodiments, a center cavity may be formed to facilitate the connection of a rotating shaft.

The metal layer 790 includes metal protrusions 794 directed toward both the top and bottom crystalline ceramic layers 792. The top and bottom crystalline ceramic layers 792 are perforated with holes so that the protrusions 794 of the metal layer 790 can connect with the crystalline ceramic layers 792.

The crystalline ceramic body of the base layer can have one or more notches 748 forming an indentation on the outside edge of the base of the anode 732. The notches 748 on the base of the anode 732 can vary in depth and breadth, and may be positioned so as to balance the weight of a spinning anode 732.

The surface 750 of the anode 732, forming the top crystalline ceramic layer 792, includes a beveled surface 750 that slopes down and away from the center of the anode 732 such that the depth of the crystalline ceramic body is thinner at the periphery than the interior of the anode 732. The region closest to the center of the anode 732 is flat, but the surface 750 begins to slope at an inflection point 754 and continues in the sloped trajectory until the edge of the anode 732.

Any methods disclosed herein include one or more steps or actions for performing the described method. The method steps and/or actions may be interchanged with one another. In other words, unless a specific order of steps or actions is required for proper operation of the embodiment, the order and/or use of specific steps and/or actions may be modified.

Reference throughout this specification to "an embodiment" or "the embodiment" means that a particular feature, structure or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim requires more features than those expressly recited in that claim. Rather, as the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

Recitation in the claims of the term "first" with respect to a feature or element does not necessarily imply the existence of a second or additional such feature or element. Elements recited in means-plus-function format are intended to be construed in accordance with 35 U.S.C. § 112(f).

It will be apparent to those having skill in the art that changes may be made to the details of the above-described embodiments without departing from the underlying principles of the invention. Embodiments of the invention in which an exclusive property or privilege is claimed are defined as follows.

What is claimed is:

1. An X-ray anode, comprising:

a ceramic body that emits X-rays at least in a thermally excited state in response to incident electrons from an electron beam, and for at least a first temperature range, increases in thermal conductivity with increased temperature; and one or more conductive metal wires thermally coupled to the ceramic body to receive a plurality of incident electrons from the electron beam, wherein the received plurality of incident electrons increases the thermal energy in the conductive metal wires, and the conductive metal wires diffuse the increase in thermal energy to the ceramic body, such that the temperature of the ceramic body increases as does the thermal conductivity of the ceramic body for at least the first temperature range.

2. The X-ray anode of claim 1, wherein the ceramic body comprises yttrium aluminum garnet.

3. The X-ray anode of claim 1, wherein a thermally unexcited state comprises temperatures below approximately 100 degrees Celsius.

4. The X-ray anode of claim 1, wherein the first temperature range, where thermal conductivity increases as temperature increases, includes temperatures between 30 degrees Celsius and 500 degrees Celsius.

5. The X-ray anode of claim 1, wherein the conductive metal wires extend radially out relative to the ceramic body.

6. The X-ray anode of claim 1, wherein the conductive metal wires comprise one conductive metal wire that forms a spiral beginning at the center of the ceramic body and ending at the edge of the ceramic body.

7. The X-ray anode of claim 6, wherein the spiral tightens proximate the location where the electron beam strikes the anode.

8. The X-ray anode of claim 1, wherein the conductive metal wires are partially contained within the ceramic body.

9. The X-ray anode of claim 8, wherein the conductive metal wires are exposed proximate a location at which the electron beam strikes the X-ray anode.

10. The X-ray anode of claim 1, further comprising an aperture through which a shaft can be connected to rotate the X-ray anode during operation.

11. The X-ray anode of claim 1, wherein the ceramic body comprises yttrium oxide.

12. The X-ray anode of claim 1, further comprising a metal backing.

13. An X-ray anode, comprising:

a ceramic body that conducts electrons and emits X-rays in response to the incidence of the electrons when in a thermally excited state; and a conductive metal film thermally coupled to the ceramic body to receive a plurality of electrons from an electron beam, wherein the received electrons produce an increase in thermal energy in the conductive metal film, and the conductive metal film diffuses the increase in thermal energy to the ceramic body.

14. The X-ray anode of claim 13, wherein the conductive metal film covers the entire ceramic body.

15. The X-ray anode of claim 13, wherein the conductive metal film is fused to a top portion of the ceramic body.

16. The X-ray anode of claim 13, wherein the ceramic body further comprises a track at least where the electron beam strikes the X-ray anode, and wherein the metal film is contained within the track.

17. The X-ray anode of claim 13, wherein the ceramic body further comprises electron windows where the electron beam strikes the X-ray anode when in a thermally unexcited state, and wherein the metal film is contained within the ceramic body.

18. An X-ray anode, comprising:

a ceramic body that conducts electrons and emits X-rays in response to the incidence of the electrons when in a thermally excited state; and a conductive metal deposited onto the ceramic body to receive a plurality of electrons from an electron beam, wherein the received electrons produce an increase in thermal energy in the deposited conductive metal, and the deposited conductive metal diffuses the increase in thermal energy to the ceramic body.

19. The X-ray anode of claim 18, wherein the conductive metal is deposited onto the ceramic body using doping.

20. The X-ray anode of claim 18, wherein the ceramic body is infused with the deposited conductive metal.

21. An X-ray anode, comprising:

a ceramic body that emits X-rays in a thermally excited state in response to incident electrons from an electron beam, and for at least a first temperature range, increases in thermal conductivity with increased temperature; and a conductive metal thermally coupled to the ceramic body to receive a plurality of incident electrons from the electron beam, wherein the received plurality of incident electrons increases the thermal energy in the conductive metal, and the conductive metal transfers thermal energy to the ceramic body to cause the temperature of the ceramic body to increase.

* * * * *